US005791000A

United States Patent [19]

Noyes

[11] Patent Number: 5,791,000

[45] Date of Patent: Aug. 11, 1998

[54] SUPPORT DEVICE

[76] Inventor: Lily Noyes, 6615 Lake Shore Dr. S. Apt. #705, Richfield, Minn. 55423

[21] Appl. No.: 675,289

[22] Filed: Jul. 1, 1996

[51] Int. Cl.[6] ..... A47C 20/08

[52] U.S. Cl. ..... 5/657; 5/630; 5/633; 5/650; 5/662

[58] Field of Search ..... 5/630, 632, 633, 5/650, 648, 652, 653, 657, 662; 54/44.1, 44.2, 44.3, 46.1, 462

[56] References Cited

U.S. PATENT DOCUMENTS

| | | | |
|---|---|---|---|
| D. 182,801 | 5/1958 | Garshof | D15/8 |
| D. 183,364 | 8/1958 | Monroe et al. | D15/8 |
| D. 221,726 | 9/1971 | Johnson | D5/4 |
| D. 341,965 | 12/1993 | Chapman | D6/501 |
| 914,785 | 3/1909 | Boyce | 5/633 |
| 1,047,231 | 12/1912 | Ingman . | |
| 1,201,157 | 10/1916 | Dawes . | |
| 2,914,116 | 11/1959 | Gohmann | 155/169 |
| 3,021,837 | 2/1962 | Newell | 128/71 |
| 3,343,184 | 9/1967 | Friedman et al. | 5/317 |
| 3,776,540 | 12/1973 | Comando | 5/650 |
| 3,896,787 | 7/1975 | Withers | 5/630 |
| 3,907,270 | 9/1975 | Ezzo | 269/328 |
| 3,931,654 | 1/1976 | Spann | 5/650 |
| 4,135,504 | 1/1979 | Spann | 5/651 |
| 4,536,032 | 8/1985 | Highberger | 297/439 |
| 4,608,811 | 9/1986 | Echeverri | 54/44.2 |
| 4,765,005 | 8/1988 | Hippel | 5/443 |
| 4,805,605 | 2/1989 | Glassman | 5/650 |
| 5,235,714 | 8/1993 | Toso | 5/657 |
| 5,375,279 | 12/1994 | Toso | 5/657 |
| 5,497,521 | 3/1996 | Waits et al. | 5/568 |

*Primary Examiner*—Steven N. Meyers
*Assistant Examiner*—Robert G. Santos
*Attorney, Agent, or Firm*—Myers Liniak & Berenato

[57] ABSTRACT

A support device is disclosed that includes a base attached to two spaced straps with a plurality of adjustable footholds. The support device permits users to maintain a seated position with their legs drawn up on a bed or other support surface without requiring any effort or exertion on the part of the user to retain their legs in this position. The device does not require attachment to the support surface, but rather depends upon the user's own weight to anchor the base and support the user's feet and legs.

12 Claims, 2 Drawing Sheets

SUPPORT DEVICE

BACKGROUND OF THE INVENTION

This invention relates to a foot contacting leg support device that utilizes the downward force of the user's own weight to maintain its position. More particularly, the present invention relates to an adjustable support device that allows users to maintain one of a variety of possible preselected positions wherein their knees are bent, their feet are stationary and supported and their thighs are angled up away from the bed chair or other surface. The present invention therefore permits users to comfortably read in bed by resting a book on their thighs with their feet and legs held in position to prevent slipping without requiring any exertion or effort on the part of the user to maintain that position.

Reading in bed or on a sofa or other chair with one's legs off the floor has become a popular activity among many individuals. Although engaging in this activity is desired by many, carrying it out often presents some logistical problems. To begin with, if an individual wants to read in bed he needs to position a book or other printed matter sufficiently close enough to his eyes in order to adequately view the material and its contents without causing eye strain. Beds frequently provide headboards and the like which supply adequate support for the user to lean his back against, but their mattresses are generally perpendicular to the headboard and, as such, they do not afford any support surface for a book or the like at a reasonable viewing distance from the reader's eyes.

As a result, the reader has generally three options. First, he can hold his arms outwardly to support the book at a height sufficiently elevated from the bed itself. This of course quickly leads to fatigue and strain in the arms usually bringing about a premature end to any reading session.

Similarly, if the user instead draws his feet up to support the book or his arms, he must battle against his feet slipping on the bed by constantly exerting effort to prevent this unwanted event from occurring. This of course is not a desirable solution since the reader generally is desiring a pleasurable, relaxing reading experience, rather than extended exercise of his abdominal muscles. The above problems are exacerbated if the reader is disabled in any way or in a weakened physical condition.

Several devices have been provided to attempt to prevent an individual's feet from slipping on a bed or similar surface and allow his legs to be drawn up without requiring additional exertion or effort. These solutions, however, have generally proven to be too complicated, cumbersome, limiting and/or otherwise inadequate. For example, U.S. Pat. No. 4,765,005 to Hippel discloses a foot support system including an adjustable foot support for aiding persons in maintaining a sitting position while in bed on a mattress surface or other personal support. This device, however, requires a tubular support system and a rope or other attachment device to be positioned around the back of the headboard of a bed. This rope construction does not permit users of different height to be readily accommodated and may damage the headboard. Moreover, the tubular member allows little or no transverse movement of the user's legs while in a seated position.

U.S. Pat. No. 1,047,231 to Ingman provides a hospital appliance that enables a patient to sit up or half recline and be braced from the tendency to slip. The Ingman device, however, requires its straps to be secured to the post of a bedpost or similar support surface that could cause damage to the bed or not be possible. In addition, the device itself is only suited to persons of a certain height and is not readily adjustable to accommodate those of different height or to permit multiple different angles of incline or bend for the user's legs. In addition, the device does not readily permit lateral movement of the legs while in a variety of different incline positions.

U.S. Pat. No. 1,201,157 to Dawes discloses a surgical sheet for use under bed patients. The sheet is equipped with foot supports or rests to enable a person in bed to draw up his feet to afford a rest or change of position. The Dawes device affords only a single foot position. In addition, its sheet-like construction makes it difficult to use it close enough to a headboard or the like to provide back support to a user while his feet are engaged in the loops or pockets. Additionally, the structure of the sheet does not permit any lateral movement of the feet when they are engaged in the pockets. Moreover, when not in use, the sheet must be changed or the user will lie uncomfortably on the loops and pockets.

Accordingly, a need exists for a device for supporting a user's feet that enables a person on a bed or similar surface to draw his feet up and bend his legs in a variety of different positions that holds the user's feet in a position against slipping without requiring any exertion or effort on the part of the user that does not require attachment to the bed or other device, readily accommodates persons of different height and permits a wide range of lateral movement of the feet while the user's legs are in a supported position.

SUMMARY OF THE INVENTION

It is therefore an object of the present invention to provide a support device of the simple construction that is portable and can maintain a person in a variety of different preselected positions with his legs drawn up and feet held in position against slipping without requiring any exertion or effort on the part of the user.

It is another object of the present invention to provide a support device that provides a plurality of different footholds that accommodate users of different heights and permit users to selectively maintain their legs at various stages of incline.

Yet another object of the present invention is to provide a support device that does not require attachment to the bed or other support means that the user is sitting on.

A still further object of the present invention is to provide a portable support device that permits lateral movement of the various footholds provided.

Yet another object of the present invention is to provide a support device that does not harm or otherwise affect the support structure or frame of the bed or other support device it is used in conjunction with.

Yet another object of the present invention is to provide a plurality of footholds for each foot such that one leg may be inclined and supported from slipping at a different angle of inclination than the other.

Still another object of the present invention is to provide a support device that is maintained in a stationary position while in use, a result of the downward force of the user's weight alone.

These and other objects are satisfied by an adjustable foot and leg support device comprising a base, a first strap attached to the base, the strap having a distal end that extends outwardly away from the base and a plurality of releasable means for attachment located along its length, and a second strap attached to the base, the second strap having a free distal end that extends outwardly away from the base and is spaced from and not connected to the first strap, the second strap further including a plurality of releasable means for attachment located along its length.

BRIEF DESCRIPTION OF THE DRAWINGS

For a complete understanding of the nature and desired objects of this invention, reference should be made to the following detailed description taken in connection with the accompanying drawings, wherein like reference numbers refer to corresponding items throughout the several illustrations of the preferred embodiments of the present invention and wherein.

DETAILED DESCRIPTION OF THE INVENTION

A preferred embodiment of the support device of the present invention will now be described. This embodiment is intended to be exemplary, rather than limiting. Although the present invention is primarily described in connection with facilitating reading in bed it can likewise function to permit a person to maintain a sitting position on a surface for eating, watching television or other activities that require such a position.

Figure 1:
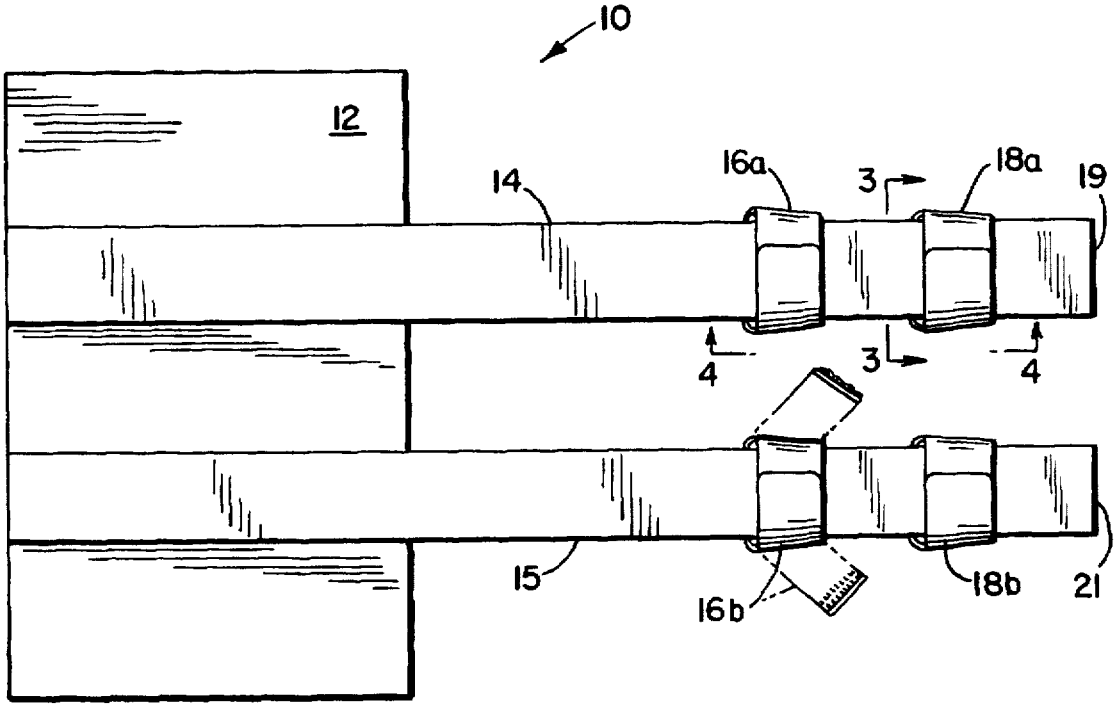
FIG. 1 is a top plan view of one embodiment of the present invention.
Figure 2:
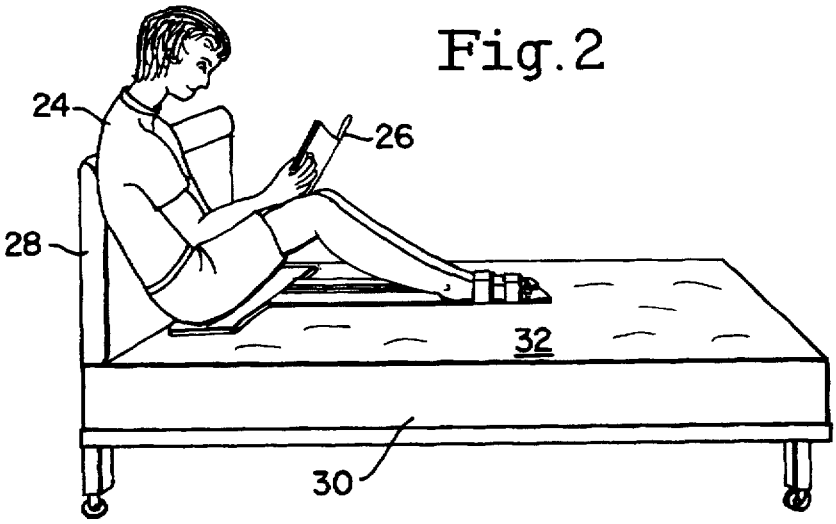
FIG. 2 is a perspective view of one embodiment of the present invention in use.
Figure 5:
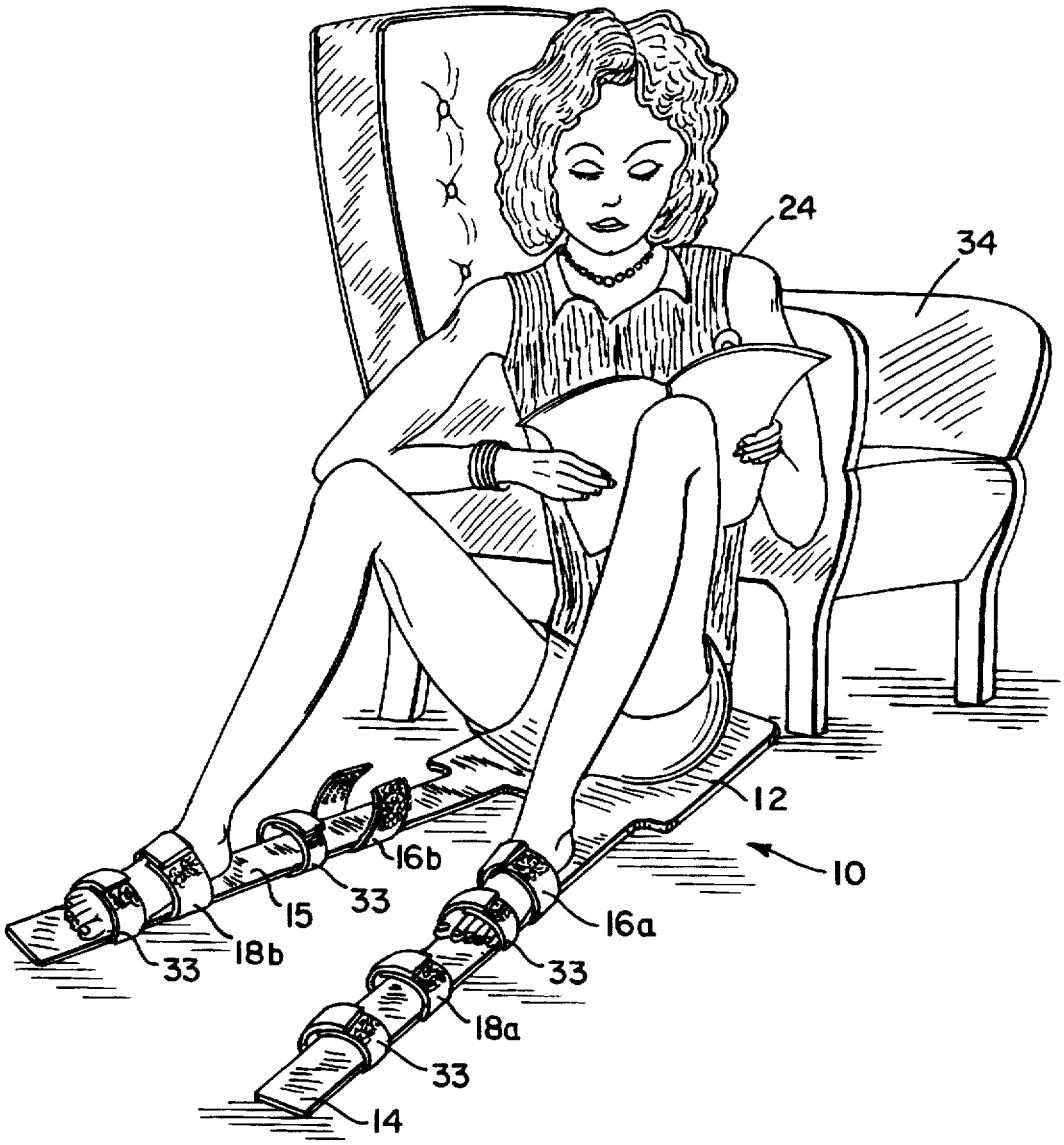
FIG. 5 is a front perspective view of one embodiment of the present invention in use.

Referring generally to FIGS. 1 and 2, the novel support device of the present invention for preventing a person from sliding from a sitting position to an inclined or supine position is illustrated and generally referred to as 10. The device is illustrated in FIG. 2 used in connection with a bed 30 having a headboard 28 and a top surface 32. It should be understood that the device 10 could also be readily used on other furniture such as sofas or chairs 34 as illustrated in FIG. 5 or other support systems such as a floor to secure the user's position in relation to some type of back support. Furthermore, the device 10 could be used in virtually an unlimited variety of locations such as homes, hospitals, nursing homes and hotels.

Referring now to FIGS. 1, 3, 4 and 5, the support device 10 generally consists of a base 12 that is attached to a pair of straps 14 and 15 respectively that extend outwardly away from the base 12. The base 12 is preferably constructed of a flexible material such as nylon, terrycloth, flannel, fur or the like. It could, however, also be constructed of other lightweight and flexible materials such as plastic. The base 12 preferably takes a rectangular form. It can be made in a variety of different sizes. The size must be adequate to accommodate a sufficient portion of the user when in a seated position to generate sufficient downward force from the user's weight alone to maintain the device stationary.

Like the base 12, the straps 14 and 15 are preferably made of a thin, flexible material such as nylon or the like. The straps 14 and 15 are connected to the top or bottom surface of the base 12. The straps 14 and 15 overlap a portion of the base and are preferably rigidly attached to a portion of the base 12 by stitching or similar means. The straps 14 and 15 may span the entire length of one dimension of the base 12 or only a portion of that dimension. Additionally, the straps 14 and 15 may be attached to the base 12 over the entire portion that they overlap the base 12 or over a smaller segment of the overlapping portion.

Although the straps 14 and 15 respectively are connected at their approximate ends to the base 12, they are not otherwise connected to the base or each other. The distal ends 19 and 21 of the straps 14 and 15 respectively extend outwardly away from the base 12. The straps 14 and 15 are spaced a distance from each other that approximates the space between opposing legs of a user. The straps 14 and 15 can be manufactured in a variety of lengths depending upon the size and length of legs of the user.

Figure 3:
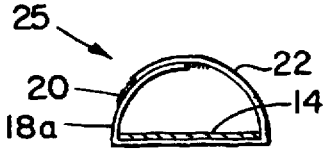
FIG. 3 is a partial cross-sectional view taken along the line 3—3 of FIG. 1.
Figure 4:
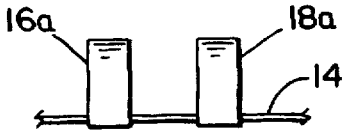
FIG. 4 is a partial side view taken along the line 4—4 of FIG. 1.

Referring now to FIGS. 1, 3, 4 and 5, the straps 14 and 15 each contain a plurality of footholds designated as 16(*a*), 16(*b*), 18(*a*) and 18(*b*). These footholds (16,18) each feature a releasable attachment mechanism 25 such as overlapping ends 20 and 22 that are releasably attached using velcro® or similar attachment mechanisms as illustrated in FIG. 3. The footholds (16,18) are designed to accommodate the feet of the user and stabilize the feet and legs of the user from sliding while the legs are in a preselected position with the user's knees drawn up above the bed or other surface. By providing opposing surfaces of or the like along the outer surface of the end 20 and the inner surface of the end 22, the footholds can be easily released and adjusted to accommodate a variety of different size users. The footholds 16 and 18 surround the straps 14 and 15 and are attached to the bottom by stitching or other permanent attachment means.

By providing a plurality of different footholds 16(*a*), 16(*b*), 18(*a*) and 18(*b*) along each of the straps 14 and 15, a user can assume a variety of different supported positions with their feet occupying footholds on opposing straps 14 and 15 that are parallel such as 16(*a*) and 16(*b*) or non-parallel such as 16(*a*) and 18(*b*). As appreciated, other releasable attachment mechanisms such as buckles or the like could also be used in place of the velcro®-type attachments. As further illustrated in FIG. 5, supplemental supports 33 could also be used in combination with the footholds 16 and 18.

Having recited the basic structure of the device 10, its function will now be discussed. The device is used by laying the base 12 flat on the top 32 of a support surface such as a bed 30 as illustrated in FIG. 2. The distal ends 19 and 21 of the respective straps 14 and 15 are then extended away from the base 12 in a spaced substantially parallel manner. It is preferable though not required that the device 10 is positioned in close proximity to a back support such as a headboard 28.

Once properly positioned, the user 24 then sits on the base 12. The downward force created by the weight of the user stabilizes the device 10. The user then slides his feet into the desired footholds, 16(*a*) and 16(*b*) for example. The ends 20 and 22 of the footholds can be released and tightened against the feet of the user 24 to adequately stabilize and hold them within the footholds. As a result, the user's legs are supported in a position with his knees bent and drawn up from the top surface 32 of the bed 30 with his feet and legs supported in a stabilized position that prevents him from slipping along the surface of the bed 30 or other support surface.

Using the present invention does not require any exertion or effort on the part of the user to maintain this preselected position. The downward force exerted on the base 12 by the user's own weight provides adequate resistance to overcome any tendency of the user's feet to slip or slide forward when in the footholds. In addition, the multiple footholds 16(*a*), 16(*b*), 18(*a*) and 18(*b*) respectively featured in the device 10 allow the user to vary his position or allow the device 10 to more easily accommodate successive users. Likewise, the manner in which the straps 14 and 15 are attached to the base 12 permits lateral movement of each of the straps so that the user does not necessarily have to maintain a position where his legs are completely or substantially parallel to each other. The ready portability of the device 10 affords further advantages. The device can be readily folded into a number of space saving configurations for storage or transport. For example, the device could be rolled up or the straps could be folded over the base followed by folding the base in half.

It is evident from the above disclosures that modifications of the present invention can readily be made that are within the scope thereof, without departing from the spirit of the invention or sacrificing the principal advantages thereof.

I claim:

1. An adjustable device for supporting the feet and legs of a user, comprising:

a substantially flat base for holding said device in position by the downward force of the user's weight alone, said base including at least front and back oppositely disposed edges;

a first strap attached to said base, said strap having a distal end that extends outwardly away from said front edge of said base and a plurality of releasable means located along a length of said first strap for surrounding the user's first foot and maintaining the user's first leg in a preselected bent position with said first strap extending under the user's first leg; and a second strap attached to said base, said strap having a free distal end that extends outwardly away from said front edge of said base and is spaced from and not connected to said first strap, said second strap further including a plurality of releasable means located along a length of said second strap for surrounding the user's second foot and maintaining the user's second leg in a preselected bent position with said second strap extending under the user's second leg, said base and said first and second straps being coplanar.

2. The device of claim 1 wherein said first and second straps have a fixed length and are laterally movable when said device is in use.

3. The device of claim 1 wherein said first and second straps overlap a portion of said base.

4. The device of claim 3 wherein said first and second straps are both connected to said base over the portion of the base that they overlap.

5. The device of claim 3 wherein said first and second straps are both connected to said base over a limited part of the portion of the base that they overlap.

6. The device of claim 1 wherein said first and second straps overlap one entire dimension of said base.

7. The device of claim 1 wherein said releasable means for both of said first and second straps comprise an overlapping attachment mechanism.

8. The device of claim 1 wherein said base is made of a fabric material.

9. The device of claim 8 wherein said straps are made of a fabric material.

10. The device of claim 1 wherein said device is foldable to a configuration that occupies less space than said base alone when said device is in an unfolded configuration.

11. The device of claim 1 wherein said releasable means of both said first and second straps are adjustable.

12. The device of claim 1 wherein said releasable means of both said first and second straps are spaced from said distal ends of said first and second straps respectively.

* * * * *